United States Patent [19]

Andresen

[11] 4,082,928

[45] Apr. 4, 1978

[54] ELECTIC SNAP SWITCH, PARTICULARLY MINIATURE SWITCH

[75] Inventor: Jens Nicolai Andresen, Sonderborg, Denmark

[73] Assignee: Danfoss A/S, Nordborg, Denmark

[21] Appl. No.: 669,670

[22] Filed: Mar. 23, 1976

[30] Foreign Application Priority Data

Mar. 25, 1975 Germany ..... 2513011

[51] Int. Cl.[2] ..... H01H 35/34

[52] U.S. Cl. ..... 200/67 DA; 200/67 PK; 200/275

[58] Field of Search ..... 200/67 D, 67 DA, 67 PK, 200/83 P, 83 V, 275

[56] References Cited

U.S. PATENT DOCUMENTS

| | | | |
|---|---|---|---|
| 2,647,968 | 8/1953 | Byam | 200/83 P |
| 2,861,142 | 11/1958 | Millerwise | 200/67 DA |
| 3,239,633 | 3/1966 | Bletz | 200/67 D |
| 3,248,496 | 4/1966 | Stafford | 200/67 D |
| 3,270,153 | 8/1966 | Buchanan | 200/67 D |
| 3,550,055 | 12/1970 | Grover | 200/67 DA |
| 3,596,023 | 7/1971 | Kothe | 200/83 P |

*Primary Examiner*—Verlin R. Pendegrass
*Assistant Examiner*—Ralph Palo

[57] ABSTRACT

This invention relates to a snap action type of switch in which a generally G-shaped sheet metal strip has a fixed terminus and a movable terminus forming an inwardly and upwardly extending arm which is pivotally mounted in a knife bearing. The midportion of the strip extends between fixed contacts and has a contact thereon which alternately engages the fixed contacts. An actuator is movable transversely of the strip and engages the arm of the strip to move the movable contact in the opposite direction relative to the movement of the actuator.

3 Claims, 7 Drawing Figures

ELECTIC SNAP SWITCH, PARTICULARLY MINIATURE SWITCH

The invention relates to an electric snap switch, particularly a miniature switch, in which the snap system consists of a single, clamped, three- dimensionally deformed spring metal sheet which carries the contact at one surface section and, at another surface section, forms an operating member movable towards the clamping plane with the aid of an actuating element for the purpose of snapping over.

In such snap switches, the spring metal sheet also assumes the function of the snap spring. When the operating member has been moved sufficiently far, the spring metal sheet snaps to a curved position that is opposite to the original curve. Since only one spring metal sheet is required, the snap switch can be made very small. It is therefore particularly suitable for use in miniature pressostats, thermostats etc.

In a known snap switch of this kind the spring metal sheet comprises three juxtaposed limbs interconnected at one side. The central limb carries the movable contact. Two bearings deforming the spring metal sheet engage the two outer limbs. The actuating element must simultaneously engage two operating regions provided beyond the two bearings at the outer limbs.

In another know snap switch, the spring metal sheet is annular. The movable contact is located at a radially inwardly extending contact arm. The operating member is provided on the side of the ring opposite the contact arm.

The known snap switches have the disadvantage that, with displacement of the operating member towards the clamping plane, the contact pressure is reduced and drops practically to zero just before snapping over. The result of this is that the contact is subjected to vibrations when the spring metal sheet has been brought by the actuating element into the vicinity of the snap-over position. Further, the contact has a high tendency to chatter and is frequently damaged by scorching.

The invention has the object of providing a snap switch of the aforementioned kind which, whilst retaining its simple construction, will always have an adequate contact pressure and can switch comparatively large currents particularly despite its small dimensions.

This object is achieved according to the invention in that the spring metal sheet comprises a spring arm made in one piece therewith to form a storage spring in the region of the operating member, the end of the spring arm being engaged by the actuating element.

The spring arm serving as storage spring does not involve additional expense because it is made in one piece with the spring metal sheet. With this construction, movement of the actuating element does not cause the same motion of the operating member; instead, the operating member is retarded with respect to movement of the actuating element, whilst simultaneously stressing the spring arm, or it even remains completely stationary. If, however, the force of the storage spring exceeds the force of the clamped spring metal sheet, the system snaps over into the other switching position. Snapping over in every case takes place before the spring metal sheet has reached the dead centre position. Accordingly, the contact pressure is also kept at an adequate level until snapping ever occurs. Immediately after snapping over, there is again a secure position for the snap system, out of which it can only snap back again if the actuating element has moved back by a switching difference. If, however, the contact pressure cannot be reduced to below a predetermined minimum size, e.g. 10p, without the snap system immediately snapping over, a snap switch is obtained which, despite its small size, is freer from vibrations, works without chatter and controls even high currents.

In a preferred embodiment, it is ensured that the spring metal sheet has the form of an annular strip with adjacent ends, is held at one end by a carrier, is pivotably mounted by the outer edge near the other end in a knife bearing, the spring arm extending substantially radially inwardly from the operating member at this location, and has the contact between the ends. Such a snap switch permits the current to be supplied to the movable contact by way of the fixed end. In addition, comparatively large deformations can be achieved because the entire length of the annular strip is available for this.

It is particularly favourable if a return spring against which the spring arm abuts before reaching the clamping plane is provided on the free end of the spring arm at its side opposite to the actuating element. This return spring automatically returns the snap switch to the rest position when the actuating element is moved back.

A particularly simple construction is obtained if the knife bearing is made in one piece with the carrier. This results in a simple construction which is enhanced by the adjacent position of the two ends of the annular strip. Also, the two clamping positions of the spring metal sheet are accurately associated with one another.

The return spring may also be attached to the carrier. In one embodiment, the knife bearing comprises a lug which is bendable in the clamping plane and provided on the carrier which is in the form of a sheet metal shaped member. By bending the lug, the initial deformation of the spring metal sheet and hence of the contact pressure can be set.

In another embodiment, the carrier comprises a supporting surface extending in the clamping direction and the spring metal sheet has its end welded thereto in the predetermined deformed shape. The initial deformation of the spring metal sheet can be achieved in a simple manner by holding the sheet in the desired deformed position during the welding operaiton.

A foot may be formed integrally on the carrier, which foot engages through an insulating plate and to the side of which remote from the spring metal sheet a conduit is connectible. Attachment in the insulating plate suffices to hold the carrier securely. The insulating plate can, in turn, be conveniently mounted in an appliance.

A very simple structural component is obtained if a lug comprising the counterbearing extends as a continuation of the foot of the carrier which is in the form of a sheet metal shaped member, and if the supporting surface is formed by bent lug.

Advantageously, at least one second carrier for a fixed contact has a foot engaging through the insulating plate and is connectible to a conduit at the side remote from the spring metal sheet.

If the foot has sawtooth-like edges, it can be held simply by pressing it into the insulating plate. Another possibility is that the ends of the feet projecting from the insulating plate are bent over onto the plate and pressed against the plate by an insulating cover. The individual carriers are then securely held in position at least after applying the insulating cover. The particularly critical arrangement of the two bearing positions for the spring metal sheet is ensured by the mounting on a carrier.

Further, the insulating plate may be inserted in a sleeve and pressing by the insulating cover may be effected by a tension relief cover which has a central socket for the passage of an electric cable and is held down at the outer periphery by a flanged edge of the sleeve. The tension relief cover transmits the pressing force from the flanged edge onto the insulating cover and, together with the socket, which may possibly be squeezed together, also holds the cable securely.

An example of the invention will be described in more detail with reference to the drawing, wherein.

Figure 1:
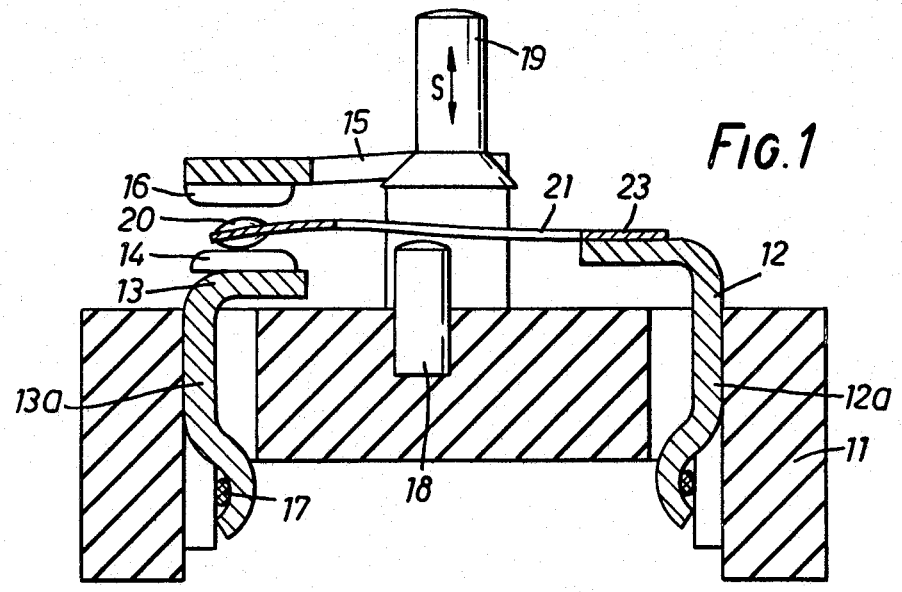
FIG. 1 is an elevational sectional view of a snap switch according to the invention.
Figure 2:
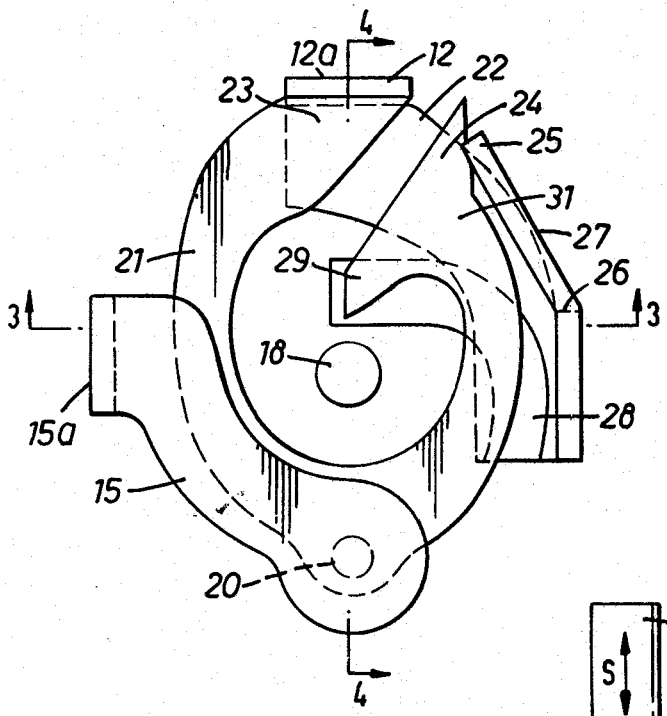
FIG. 2 is a plan view of the spring metal sheet and carriers of FIG. 1
Figure 3:
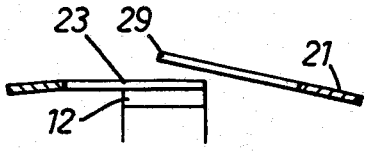
FIG. 3 is a sectional view on the line 3—3 in FIG. 2 through the spring metal sheet.
Figure 4:
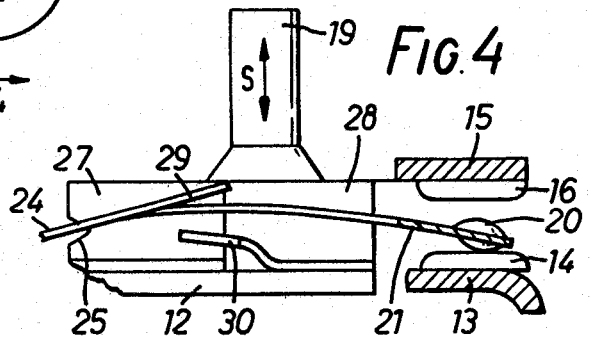
FIG. 4 is a sectional view on the line 4—4 in FIG. 2, the part of the carrier forming the fixed clamping position having been omitted.

In the embodiment according to FIGS. 1 to 4, a first carrier 12, a second carrier 13 for a first fixed contact 14 and a further carrier 15 for a second fixed contact 16 are held in an insulating plate 11 having a recess at the back. All the carriers have a foot 12*a*, 13*a* or 15*a* passing through the insulating plate 11 and at the free end of the foot carry a clamping device 17 for connecting a conduit. An abutment 18 is also provided in the insulating housing 11. A rigidly movable actuating element 19 is displaced by an operating member (not shown). The movable contact 20 is carried by a spring metal sheet 21 in the form of an annular strip. Between its ends 23 and 24 there is an interruption 22. The one end 23 is clamped tight to the first carrier 12, e.g. welded on. Near the other end, it is pivotably mounted at the outer edge 24 in a knife bearing 25. The knife bearing is formed on a lug 27 which can be bent about the line 26 and forms part of an extension 28 of the first carrier 12. A spring arm 29 extends substantially radially inwardly from this free end 24. The actuating element 19 can engage this spring arm. Further, the extension 28 of the carrier 12 is provided with a leaf-shaped return spring 30 which terminates beneath the spring arm 29 above the clamping plane.

In this construction, the spring arm 29 serves as a storage spring. A certain path S of the actuating element 19 is, with simultaneous building up of a spring force, transmitted to the spring metal sheet 21 in such a way that the angle of curvature with respect to the clamping plane is reduced in the operating portion 31. Shapping overtakes place before reaching the clamping plane because the transverse force of the curved spring metal sheet is overcome by the force stored in the spring arm 29. In such a snap switch, the contact pressure drops when the angle of curvature is reduced. However, since snapping over takes place before the clamping plane is reached, the contact pressure does not become zero but retains a final definite value. During snapping over to the lower terminal position, the spring arm 29 takes the return spring 30 with it. Upon return of the actuating element 19, its force suffices to let the spring metal sheet 21 return to its illustrated rest position.

There are three possibilities of setting this snap switch. The operating range can be set by bending the spring arm 29. The switching difference can be set by bending one of the two contact carriers 13 or 15. The contact pressure can be set by bending the lug 27, i.e., the knife bearing 25.

The actuating element 19 may be actuated by the most varied operating devices, e.g. by a liquid-filled thermostatic system, by a steam-filled system opposed by a spring of given value, by a mechanical position senser, and the like.

Figure 5:
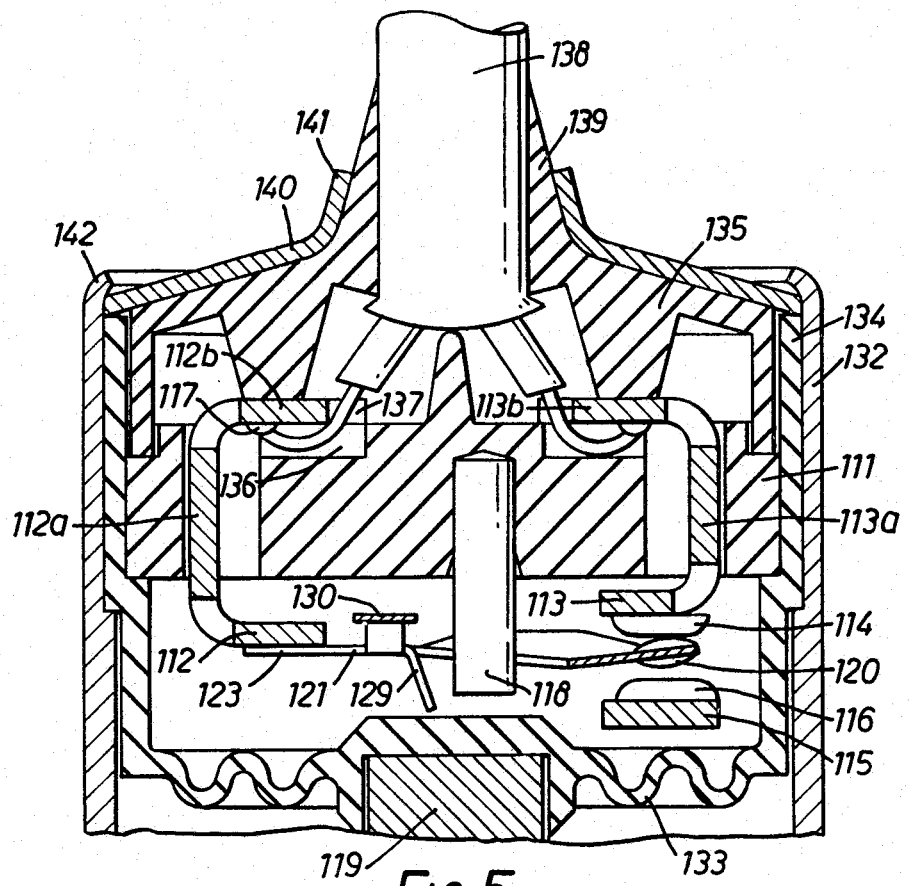
FIG. 5 is a vertical sectional view of an embodiment that has been modified with respect to FIG. 1.

In the FIG. 5 embodiment, where the snap switch has the reverse position to that of FIG. 1, corresponding parts are referenced by numerals raised by 100 relatively to FIGS. 1 to 4. A metal sleeve 132 receives the snap switch in the upper portion and an operating device for controlling the actuating element 119 in the lower portion (not shown). The actuating element acts on the spring arm 129 through the intermediary of a diaphragm 133. The diaphragm is part of an inner sleeve lining 134 which, in conjunction with an insulating cover 135, permits the snap switch to be sealingly encapsulated. The insulating plate lll is securely held between a step in the inner lining 134 and the insulating cover 135. The free ends 112*b* and 113*b* of the carriers 112 and 113 (the same applies to the carrier 115) are bent over after passing through the insulating plate lll. They are pressed against the insulating plate lll by the insulating cover 135. Depressions 136 in the insulating plate lll and recesses 137 in the carriers 112, 113 permit electric conductors to be soldered on at 117. The conductors are supplied by means of a cable 138 which engages through a neck portion 139 of the insulating cover 135. Above the insulating cover 135 there is a tension relief cover 140 having a socket 141 on the inside and overlapped at its outer periphery by a flanged edge 142 of the sleeve 132.

During assembly, the snap switch is completed first. Since its important components are freely accessible even after building into the insulating plate lll, it can also be accurately adjusted. The insulating plate lll is then inserted in the sleeve 132 and covered by the insulating cover 135 and the tension relief cover 140. The desired pressure is now applied to the tension relief cover 140 and the flanged edge 142 is produced. Finally, the socket 141 is squeezed together to substantially oval shape so as to ensure that the cable 138 cannot be pulled out again. A polyamide may for example be used as the insulating material for the various components.

Figure 6:
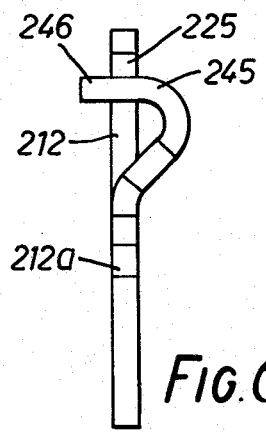
FIG. 6 is an end elevation of a modified carrier for the spring metal sheet.
Figure 7:
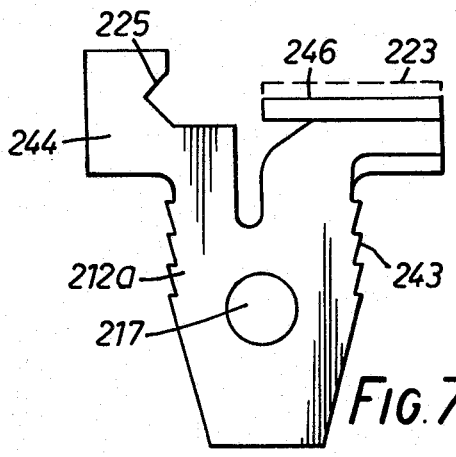
FIG. 7 is a side elevation of the carrier of FIG. 6.

FIGS. 6 and 7 show a further embodiment of a spring metal sheet carrier and reference numerals are used for it which are increased by 200 relatively to FIGS. 1 to 4. The foot 212*a* possesses sawtooth-shaped edges 243 which permit a secure hold in an insulating plate by simple pressing in. A lug 244 is provided as an extension of the sheet metal foot and it carries the counterbearing 225. The top surface of a bent lug 245 forms a supporting surface 246 for the end 223 of the spring metal sheet. This end 223 is welded to the supporting surface 246 whilst the spring metal sheet is already inserted in the counterbearing 225 and held in the desired clamped position.

I claim:

1. An electric snap switch unit comprising housing means and abutment means attached thereto, a knife edge bearing formed on said abutment means, a pair of spaced apart fixed contacts attached to said abutment means, a three- dimensional bowed snap action element formed as a generally G-shaped sheet metal strip of a spring material having a midportion extending between said fixed contacts, a movable contact attached to said strip midportion for alternate engagement with said fixed contacts, one end of said strip being fixedly attached to said abutment means and the other end of said strip being pivotally mounted in said knife edge bearing, said strip having a spring arm extending radially inwardly from said other end of said strip for creating a storage spring, and actuating means extending and being movable transversally of said strip for engaging said arm to flex said strip and thereby move said movable contact in the opposite direction.

2. An electrip snap switch unit according to claim 1 including a return spring attached to said abutment means and being engageable by said arm on the opposite side thereof from said actuating means.

3. An electric snap switch unit according to claim 1 wherein said abutment means includes lug portions, said fixed end of said strip being attached to one of said lug portions and said knife edge bearing being formed on another of said lug portions.

* * * * *